US006040752A

United States Patent [19]

Fisher

[11] Patent Number: 6,040,752

[45] Date of Patent: Mar. 21, 2000

[54] FAIL-SAFE ACTUATOR WITH TWO PERMANENT MAGNETS

[76] Inventor: Jack E. Fisher, 13 Amberly Ct., Gloucester, Ontario, Canada, K1J 8A2

[21] Appl. No.: 09/099,720

[22] Filed: Jun. 18, 1998

Related U.S. Application Data

[63] Continuation-in-part of application No. 08/844,828, Apr. 22, 1997, abandoned.

[51] Int. Cl.[7] ..... H01F 7/00; H01F 7/08

[52] U.S. Cl. ..... 335/234; 335/229; 335/230

[58] Field of Search ..... 335/229–234; 310/12–39; 251/129.01–129.22

[56] References Cited

U.S. PATENT DOCUMENTS 3,243,238 3/1966 Lyman ..... 310/90.5
4,129,187 12/1978 Wengryn et al. ..... 173/117
5,434,549 7/1995 Hirabayashi et al. ..... 335/229
5,809,157 9/1998 Grumazescu ..... 381/199
5,818,131 10/1998 Zhang ..... 310/15
5,820,104 10/1998 Koyano et al. ..... 251/326

*Primary Examiner*—Lincoln Donovan
*Assistant Examiner*—Raymond Barrera
*Attorney, Agent, or Firm*—Friedrich Kueffner

[57] ABSTRACT

An electromagnetic actuator has two permanent magnets arranged along their polar axes, with the proximal poles having same polarity. An electromagnet surrounds the two permanent magnets and, when energized, overrides the repulsion between the proximal poles and moves one permanent magnet toward the other fixed magnet. Should the electromagnet fail, the actuator reverts to the unactuated position without need of a spring, gravity and so forth.

5 Claims, 6 Drawing Sheets

FIG. 1
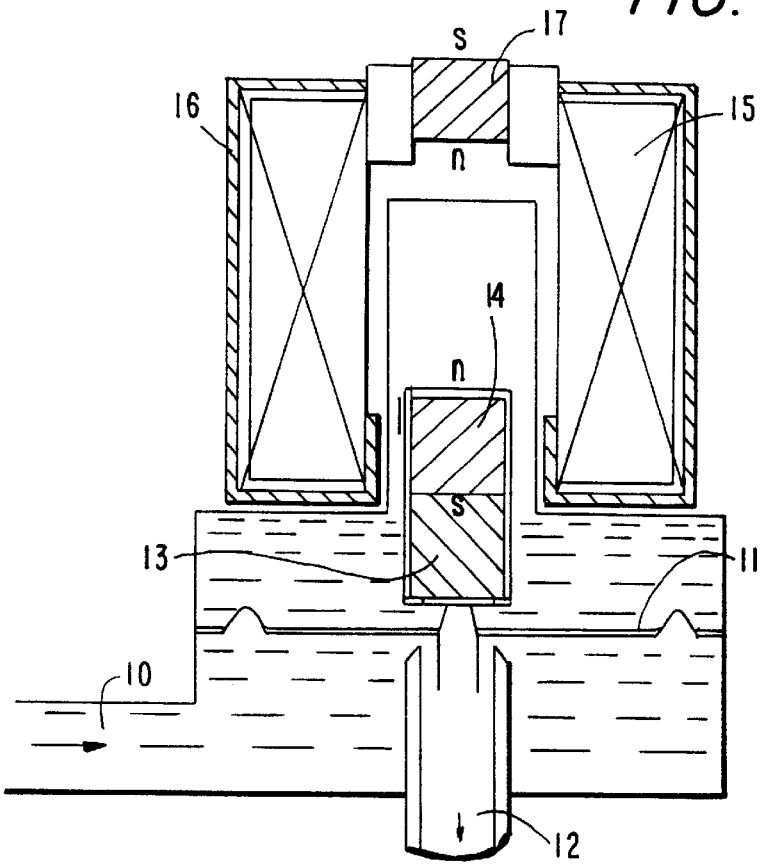
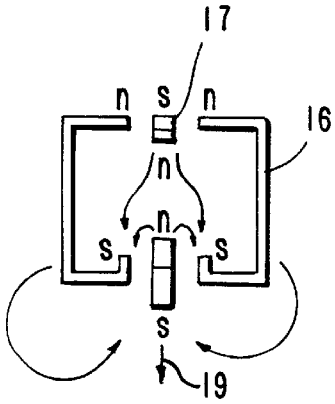
FIG. 2a
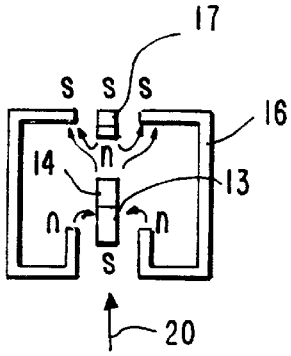
FIG. 2b
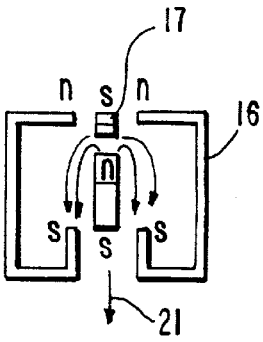
FIG. 2c

FIG. 5a
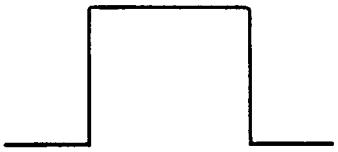
FIG. 5b
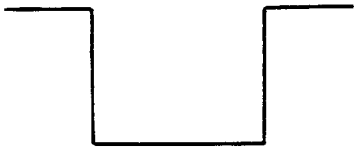
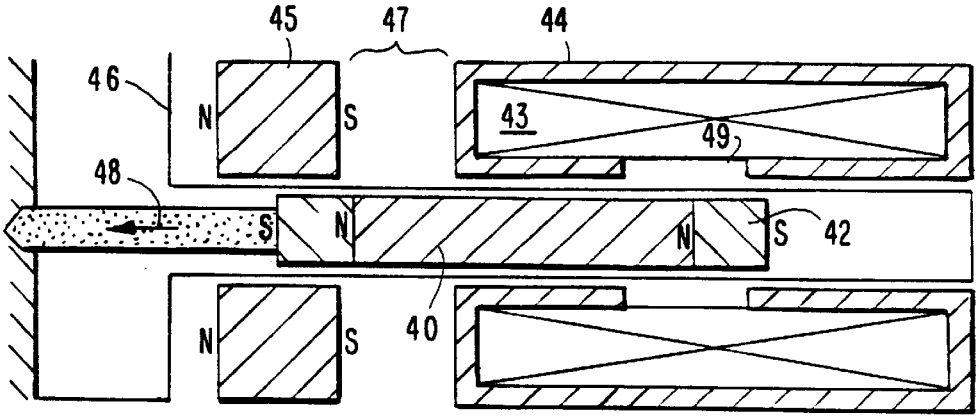
FIG. 4
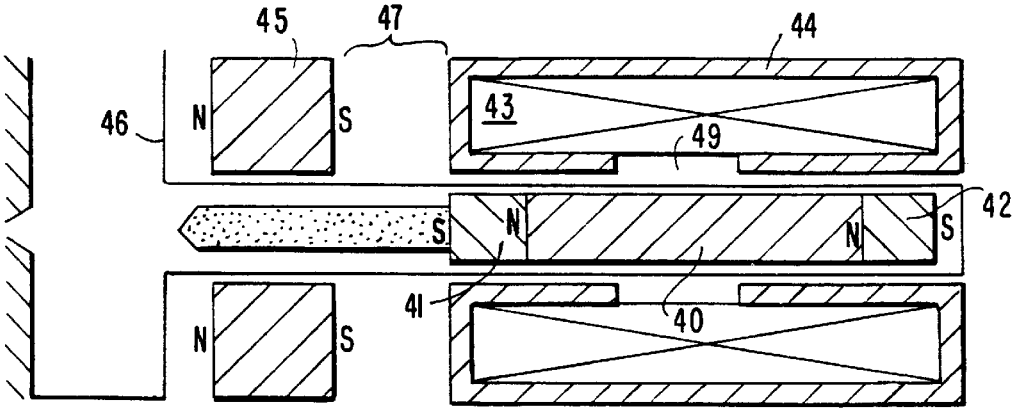
FIG. 6

FAIL-SAFE ACTUATOR WITH TWO PERMANENT MAGNETS

This is a CIP of application Ser. No. 08/844,828 filed Apr. 22, 1997, now abandoned.

BACKGROUND OF THE INVENTION

1. Field of the Invention

The present invention relates to solenoid actuators for valves and the like in general and in particular to an actuator for valves for control of fluid flow. More particularly still, it relates to a fail-safe actuator suitable for controlling flow of toxic substances or the like hazardous or corrosive fluids.

2. Prior Art

U.S. Pat. No. 4,259,653 granted Mar. 31, 1981 to McGonigal titled "Electromagnetic Reciprocating Linear Actuator with Permanent Magnet Armature" closes a springless linear actuator, especially useful as a print wire drive. A permanent magnet armature is driven from a rest position on a pole piece by magnetic repulsion upon energization of a solenoid by a D.C. pulse. The armature is fixed to a print wire which rebounds from a printing medium, thereby returning the permanent magnet toward the rest position, where it is held, without bouncing, by the magnetic attraction between the armature and the pole piece of the solenoid, which is now de-energized.

U.S. Pat. No. 5,546,063 granted Aug. 13, 1996 to Hoffman titled "Magnetic Field Solenoid" discloses an electrical coil having a central opening in which is fixedly located a rod formed of a material of the type capable of being magnetized when in a magnetic field. A plunger is supported for movement toward and away from one end of the rod. A permanent magnet is supported by the plunger. In one embodiment the permanent magnet is located such that the plunger and permanent magnet are held next to the coil when the coil is in a deactivated condition. When the coil is activated, the magnetic field produced by the coil repels the permanent magnet and hence the plunger away from the coil. The polarity of the permanent magnet can be reversed in position such that normally the permanent magnet and hence the plunger are normally repelled away from the rod end when the coil is in a deactivated condition. When the coil is activated in a given manner, the magnetic filed of the coil pulls the magnet and hence the plunger next to the coil. In another embodiment two permanent magnets are attached to opposite ends of a plunger of the type unaffected by a magnetic field to form a push-pull type of solenoid.

U.S. Pat. No. 5,497,135 granted Mar. 5, 1996 to Wisskirchen et al. titled "Bistable Electromagnet, particularly an Electromagnetic Valve" discloses a bistable electromagnet moved from one operating position into the other by a short direct current pulse, the next pulse following in each case having the opposite current direction. The essential factor in this is a permanent magnet which is arranged in the core area and which holds the armature against the action of an armature spring in one operating position. An electromagnet constructed in this manner can be produced without tolerance calibration and requires less control power when the permanent magnet is carried freely movably between two end positions in the direction of armature movement in a hollow space of the coil core. The coil core can be constructed as a pot, at the bottom of which the permanent magnet is magnetically held whilst the permanent magnet is held in the other end position by a stop in such a manner that its side facing the armature is approximately flush with the edge of the pot.

The closest prior art known is U.S. Pat. No. 4,534,537 granted Aug. 13, 1985 to Zukausky titled "Pilot Operated Valve Assembly" discloses a pilot operated valve assembly including a flexible diaphragm which selectively engages a valve seat to open and close a fluid passage through the valve. The diaphragm has a plurality of filtering apertures and an inward peripheral attaching projection. A diaphragm insert is frictionally received in the diaphragm. The diaphragm insert has a pilot supply aperture in fluid communication with a peripheral recess extending inward from a peripheral edge. The diaphragm filtering apertures are disposed in fluid communication with the peripheral recess and the pilot supply aperture. The insert peripheral edge has a peripheral valley for receiving the peripheral projection of the diaphragm. The insert has a pilot outlet aperture which is selectively opened and closed by an armature assembly. A guide shell aligns the armature assembly with the pilot outlet aperture and defines a pilot reservoir with the diaphragm. This United States patent is incorporated herein by reference.

SUMMARY OF THE INVENTION

The present invention endeavours to provide a springless fail-safe electromagnetic actuator for valves or the like. What is meant by fail-safe is that should the controlling electrical power fail, the actuator will revert to its unactuated position by virtue of the interaction of two permanent magnets. In the preferred embodiment, one of the two permanent magnets is fixed in position and the other is part of a reciprocating actuator armature.

The electromagnetic actuator has two permanent magnets arranged along their polar axes, with the proximal poles having same polarity. The electromagnet surrounds the two permanent magnets and, when energized, overrides the repulsion between the proximal poles and moves one permanent magnet toward the other fixed magnet. Should the electromagnet fail, the actuator reverts to the unactuated position without need of a spring, gravity and so forth.

According to the present invention, an actuator comprises first and second permanent magnets arranged such that their proximal poles have the same polarity and that an electromagnet is arranged such that upon magnetization in a predetermined manner its magnetization causes a net force causing at least one of said proximal poles to move toward the other; whereby upon demagnetization or failure of said electromagnet said at least one of said proximal poles moves away from the other proximal pole.

According to another aspect of the present invention, an actuator comprising: a magnetizable yoke having a central aperture within which an armature made of soft iron reciprocates; a ring magnet proximal one end of said yoke and having its central aperture coextensive with the central aperture of said yoke; said armature having a first permanent magnet affixed to its end near said ring magnet; and said armature reciprocating between open and closed positions upon momentary magnetization of said yoke by means of an electrical pulse having predetermined polarity.

BRIEF DESCRIPTION OF THE DRAWINGS

The preferred embodiment of the present invention will now be described in conjunction with the annexed drawing figures, in which:

FIG. 1 shows a cross-section of an actuator according to the present invention;

FIGS. 2*a*, 2*b* and 2*c* illustrate the operation of the actuator of FIG. 1 in the off-position, in the on-position and in the on-position immediately following power failure, respectively;

FIG. 4 shows a cross-section of an actuator according to the present invention for pulsed on-off operations;

FIGS. 5*a*, 5*b* illustrates on-off pulses for operating the actuator of FIG. 4;

FIG. 6 shows the actuator of FIG. 4 in the retracted (open) position;

DETAILED DESCRIPTION OF THE PREFERRED EMBODIMENTS

Figure 3:
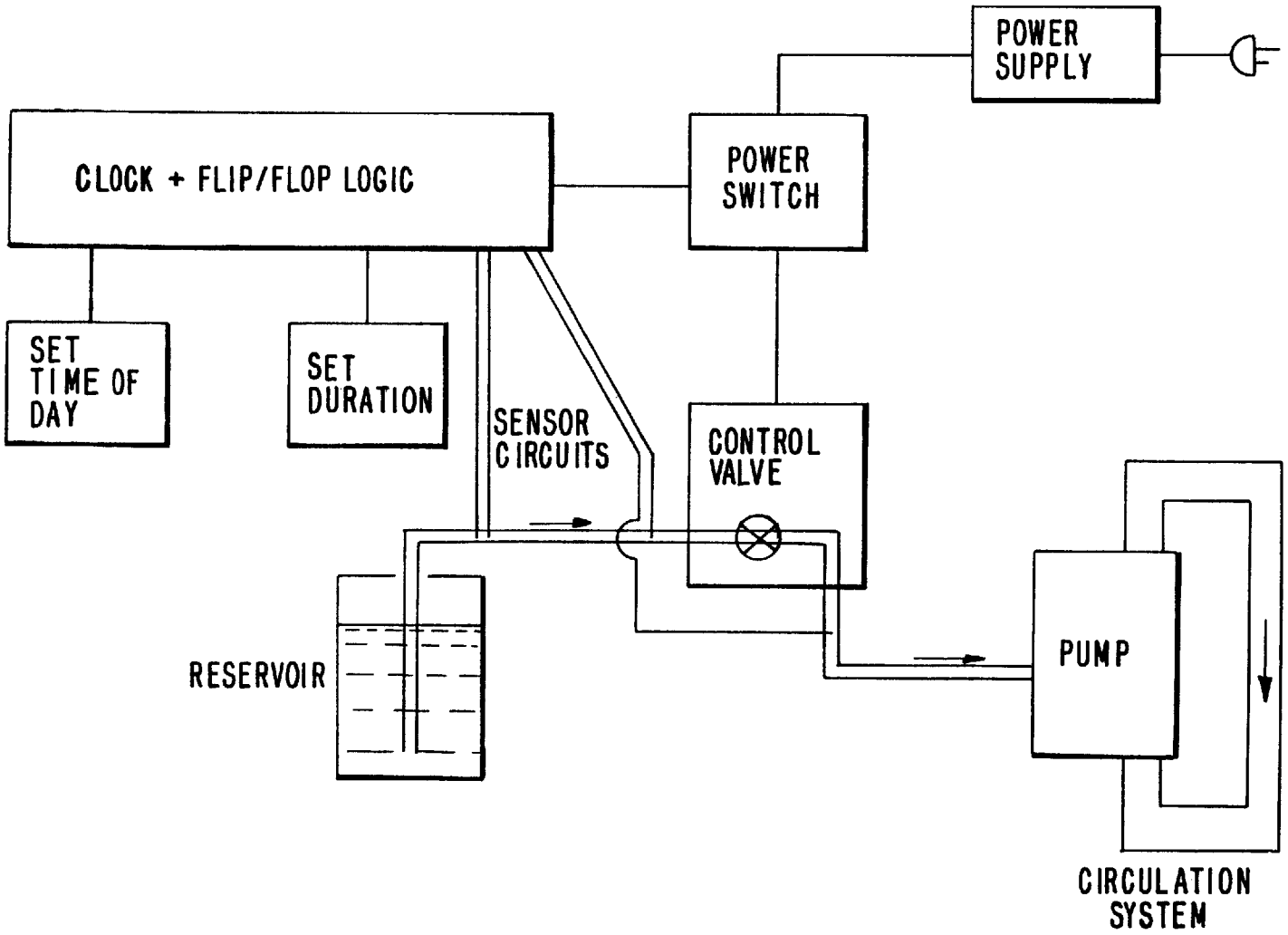
FIG. 3 is a schematic representation of a swimming pool or the like chlorination system for use with a flow control valve using the actuator shown in FIG. 1.

Referring to FIG. 1 of the drawings, the solenoid actuated fluid value controls the flow of a liquid supplied via pipe 10 by means of a moving diaphragm 11 to enable the liquid to flow through pipe 12. The diaphragm 11 is controlled by the solenoid actuator, which comprises an extension armature 13 made of soft-iron and forming the extension of an armature permanent magnet 14, such that the entire armature 13/14 is capable of reciprocating movement, within the central cavity of a solenoid 15 enclosed in a surrounding soft-iron yoke 16, toward and away from another permanent magnet 17 have the same magnetic polarity (shown here is N for north). If the permanent magnets 14 and 17 are poled as shown, then the solenoid 15 should be energized (i.e. when the actuator is on) such that the end of the yoke 16 near the magnet 17 is poled S (south), in order to over-ride the repulsive force between the magnets 14 and 17 and draw the armature 13/14 towards the magnet 17 and open the valve by removing the downward pressure on the diaphragm 11.

To explain the interaction between the yoke 16 and the magnets 14 and 17, we refer to FIGS. 2*a*, 2*b* and 2*c*. In FIG. 2*a*, the solenoid is off and the valve is closed, because the two magnets 14 and 17 repel each other and the yoke 16 acquires polarities as shown, reinforcing the repulsion. The net force is toward the diaphragm 11 as indicated by the arrow 19. To turn the actuator on, the solenoid 15 is energized and the yoke 16 acquires the polarity as shown in FIG. 2*b*. The over-riding magnetic field of the yoke 17 attracts the north pole of the armature magnet 14 towards (and in spite of) the magnet 17 and the pressure on the diaphragm 11 is released as indicated by the arrow 20.

Now what happens should the power energizing the solenoid 15 fail, is that the yoke 16 immediately loses its strong magnetization and, as shown in FIG. 2C, reverts to its previous polarization as in FIG. 2A. The result is that a net force on the armature 13/14 as shown by arrow 21 is produced, which moves the diaphragm 11 to shut the fluid flow. Note that this fail-safe action does not depend on springs (which could break), nor does it depend on the action of gravity, so that the actuator of the present invention has no preferred orientation in space.

Shown in FIG. 3 is a chlorination arrangement for a swimming pool, which used a modified valve manufactured by Eaton Corporation (designated DW-163). The actuator of the DW-163 valve was modified according to FIG. 1 of the drawings, with the solenoid having a coil resistance of approximately 274 Ohms energized by a 27 Volts DC. The permanent magnets used were Neodymium short rod magnets of Master Magnetics Inc. (Castle Rock, Colo., U.S.A.) designated NEO-27. The magnets have a high resistance to demagnetization of −10 Koe and are 0.25 inches long and 0.187 inches in diameter.

Turning now to the alternative embodiment shown in FIG. 4, the solenoid shown is operable by momentary pulses only and does not require sustained power in the valve opened position, which is desirable in some applications. The solenoid as shown in FIG. 4 is activated to open the valve by the pulse shown in FIG. 5*a* and activated to close the valve by the opposite polarity pulse shown in FIG. 5*b*. The solenoid actuator now comprises three parts: an intermediate soft-iron armature 40 having two cylindrical permanent magnets 41 and 42 at its ends. The solenoid actuator reciprocates within the central cavity of a solenoid 43 within soft-iron toroidal yoke 44, which is shaped like a squared C in axial cross-section as shown. A ring magnet 45 having the same diameter as the cylindrical yoke 44 surrounds a fluid enclosure 46 of the valve with a fixed gap 47 between the ring magnet 45 and the yoke's 44 end near the magnet 41. The ring magnet 45 is polarized as indicated in FIG. 4, having its opposite sides of opposite polarity ,and the magnet 41, which has its end of opposite polarity as shown, is the only permanent magnet which interacts with the ring magnet 45.

Assuming that the valve was in the open position as shown in FIG. 6 and a pulse as shown in FIG. 5*b* is applied to the solenoid 43, repulsing the magnet 41 and attracting 42 thereby moving the reciprocating actuator (40/41/42) to the position as shown in FIG. 4 and remains in that position after the FIG. 5*b* pulse has ended due to a static force in the direction of the arrow 48 because of the interaction between the magnet 41 and the ring magnet 45. To open the valve by moving the actuator (40/41/42) to the position illustrated in FIG. 6, a positive going pulse as shown in FIG. 5*a* is applied momentarily to the solenoid 43, which magnetizes the yoke 44 in the reverse polarity to that produced by the FIG. 5*b* negative going pulse. Thus the magnet 42 moves into the position shown in FIG. 6 away from the yoke's 44 gap 49 edges, depending on how the edges of the gap 49 are poled as either of the pulses in FIGS. 5*a* and 5*b* is momentarily applied.

As a variation on the configuration shown in FIGS. 4 and 6, it is possible to reverse the polarities of the two cylindrical magnets 41 and 42, in which case the free ("N") end of the magnet 41 would exit beyond the "N" end of the ring magnet 45 in the actuator's open position. In the closed position, the free end of the magnet 41 would be retracted between the south pole and the central plane of the ring magnet 45, which again would produce a static force keeping the actuator in that position after cessation of the closing pulse.

Figure 7:
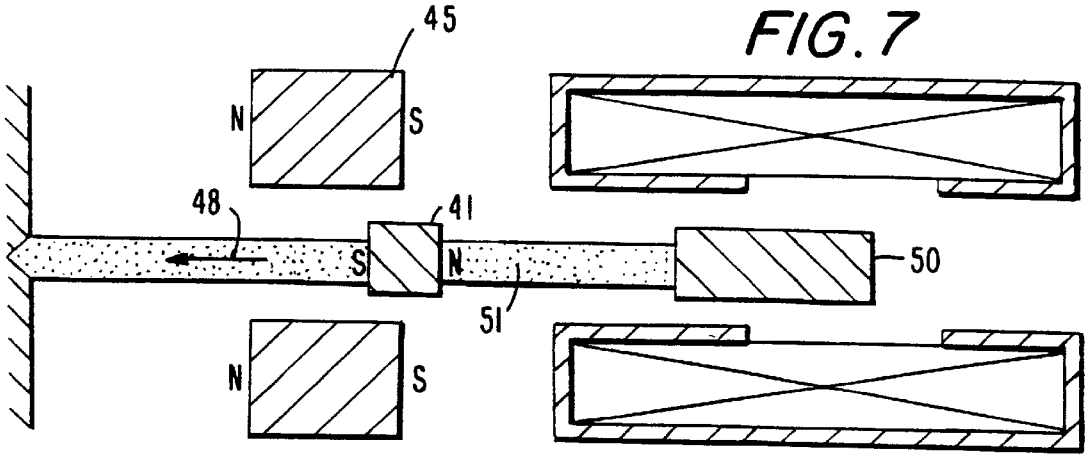
FIG. 7 shows an alternative embodiment to that shown in FIG. 4 with only one magnet in the reciprocating armature.
Figure 8:
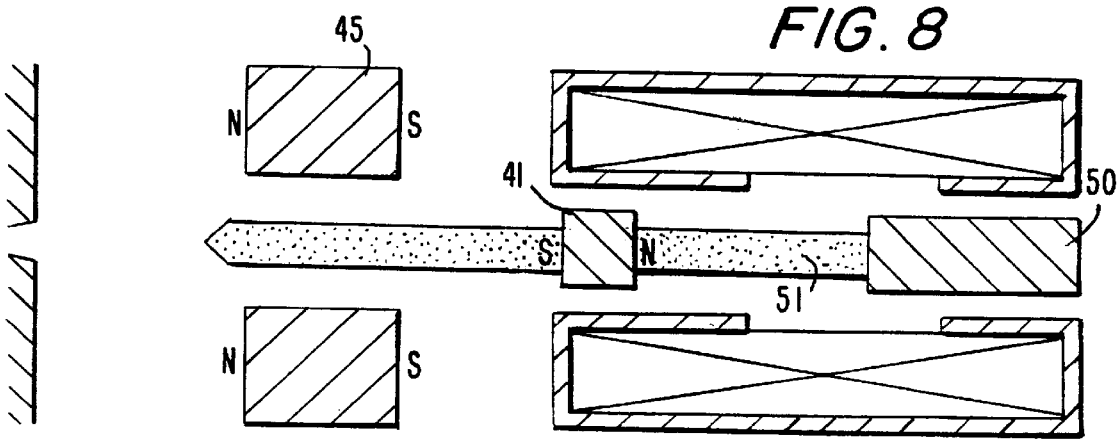
FIG. 8 shows the embodiment of FIG. 7 in the retracted (open) position.

For the embodiment of FIG. 4, the preferred components are as follows:

| | |
|---|---|
| RING MAGNET (45): | Neodymium NR788405325-27 (The Magnet Source, California) OD: 0.788 in ID: 0.405 in Thick: 0.325 in |
| ARMATURE CYLINDRICAL MAGNETS (41, 42): | Neodymium ND283N-27 DIAM: 0.25 in LENGTH 0.25 in |
| SOFT IRON ARMATURE CORE (40): | DIAM: 0.25 in LENGTH: 0.84 in |
| TOTAL ARMATURE (41, 42, 45) LENGTH: | 1.34 in (3.42 cms) |
| ARMATURE DISPLACEMENT: | Greater than ¼ in depending on relative lengths of the armature and the solenoid (the position of the gap 49) |
| SOLENOID (43): | Same as 15 in FIG. 1 |
| SOLENOID ACTIVATION PULSE: | Discharge of 400 uf capacitor at 100 volts; or Manual momentary pulse @ 200–300 mA |
| MEASURED STATIC FORCE IN "CLOSED" POSITION: | 2 LBS (40 LBS/SQ IN, FOR ¼ ORIFICE) |

Where lower forces are acceptable, the magnet 42 may be dispensed with, as shown in FIGS. 7 and 8.

FIG. 7 corresponds to FIG. 4, and FIG. 8 to FIG. 6. The only difference is that the magnet 42 has been replaced by a softiron armature 50, which is connected to non-magnetic armature 51, the other end of which is connected to the magnet 41. In order to open the valve, a pulse as in FIG. 5*a* is applied to the solenoid 43, which forces the softiron armature 50 to close the yoke 44 gap 49, the magnets 41 and 45 repel each other and the magnet 41 is attracted to the yoke 44, pushing the softiron armature 50 to one side of the yoke 44 gap 49, as shown in FIG. 8.

Figure 9A:
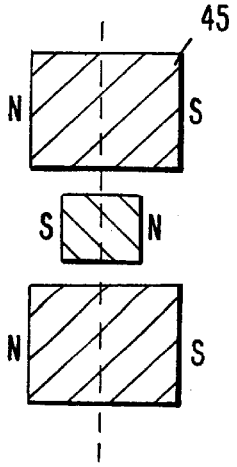
FIGS. 9*a* and 9*b* illustrate the principle of operation of the actuator of FIGS. 7 and 8.
Figure 9B:
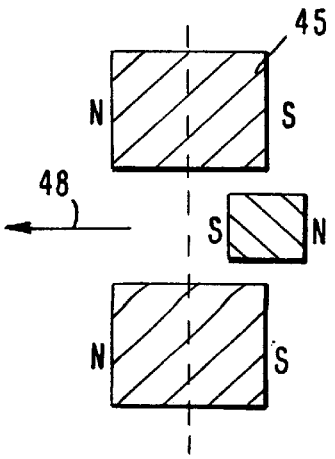
Figure 10:
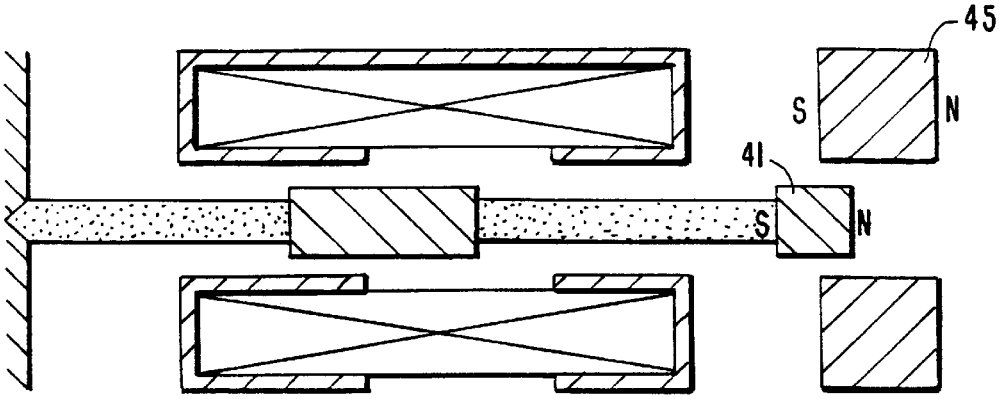
FIG. 10 shows a variation on the embodiment of FIG. 7.
Figure 11:
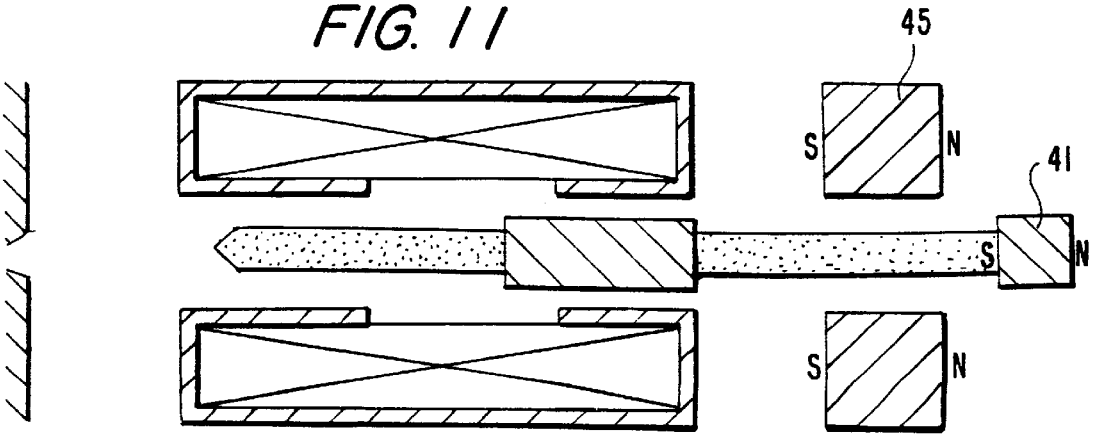
FIG. 11 shows the embodiment of FIG. 10 in the retracted (open) position.

In order to close the valve a pulse as in FIG. 5*b* is applied to the solenoid 43 and the reverse of the above description ensues, with the magnet 41 now partially inside the ring magnet 45. The result is a static force keeping the valve in the closed position, as explained by means of FIGS. 9*a* and 9*b*. FIG. 9*a* shows the equilibrium position for the magnet 41 inside the ring magnet 45. Thus, when the magnets are in the positions shown in FIG. 9*b*, which corresponds to the their position in FIG. 7, the magnet 41, being displaced from the equilibrium position, is subject to a light attractive force in the direction of the arrow 48. The valve remains closed without power being applied.

FIGS. 10–13 show variations on the construction shown in FIGS. 7 and 8, where the positions of the softiron armature 50 and the magnet 41 have been interchanged. Thus, in FIGS. 10 and 11, the valve remains closed (FIG. 10) due to a high repulsive force between the magnets 41 and 45; while it remains open (FIG. 11) when the magnets are in the equilibrium position.

Figure 12:
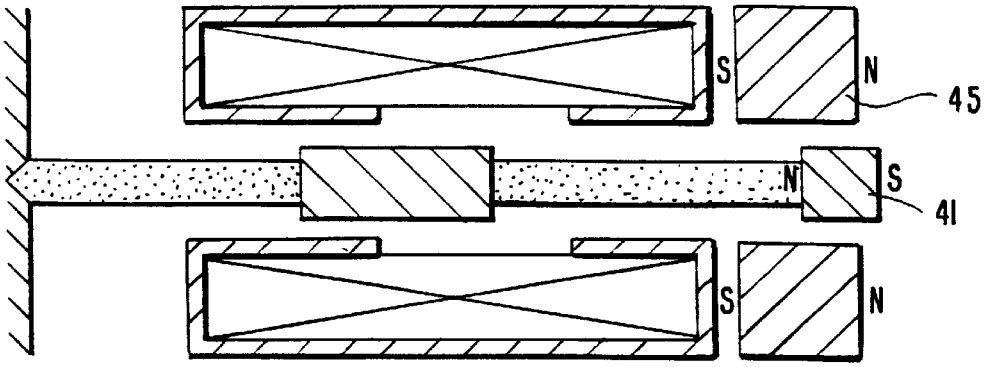
FIG. 12 shows a variation of the embodiment shown in FIG. 10.
Figure 13:
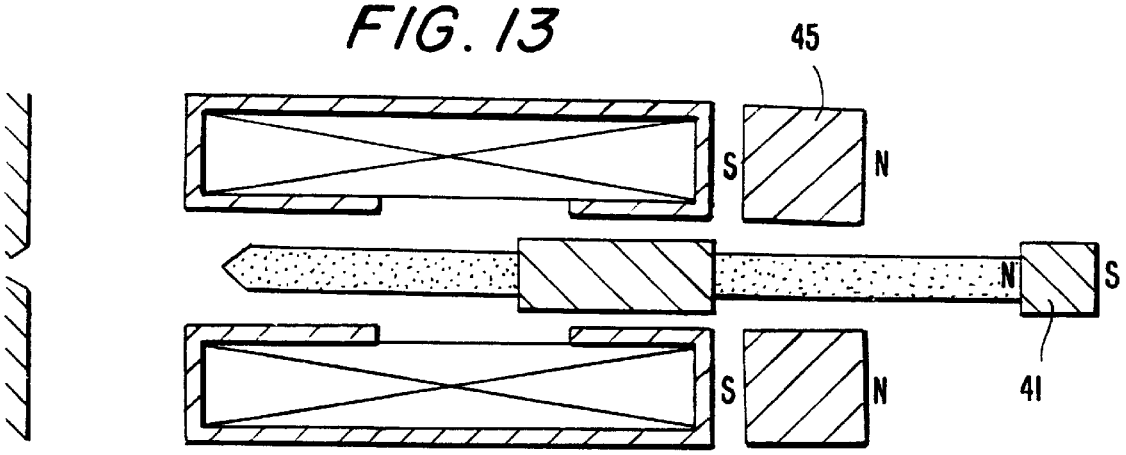
FIG. 13 shows the embodiment of FIG. 12 in the retracted (open) position.

In FIG. 12, the valve is closed due to the attractive force between the magnets 41 and 45; while in FIG. 13, the armature magnet 41 is pushed away from the ring magnet 45.

In all of the embodiments of FIGS. 4–13 only pulsed operation is required.

I claim:

1. An actuator comprising: a magnetizable yoke having a central aperture within which an armature made at least partly of soft iron reciprocates; a permanent ring magnet proximal one end of said yoke and having its central aperture coextensive with the central aperture of said yoke and having opposite sides of opposite polarity, the ring magnet being spaced a fixed distance from the yoke; said armature having a first permanent magnet affixed as part thereof near said ring magnet; said central aperture of said ring magnet sized to permit at least part of said first permanent magnet to pass into said ring magnet when moving to one of two open and closed reciprocating positions of the armature, the first permanent magnet in said one position being partially inside the ring magnet and in the other position being spaced away from the ring magnet, and the ring magnet interacting with said first permanent magnet such that when the armature is in each of the two said positions the first permanent magnet causes the armature to remain in that position, and said armature reciprocating between said open and closed positions upon momentary magnetization of said yoke by means of an electrical pulse having predetermined polarity.

2. The actuator as defined in claim 1, wherein said first permanent magnet exits the central aperture of said ring magnet in one of said open and closed positions of said armature.

3. An actuator according to claim 1, wherein said first permanent magnet is the only magnet on said armature which interacts with the ring magnet.

4. The actuator as defined in claim 1, wherein said armature has a second permanent magnet affixed as part thereof far from said ring magnet.

5. The actuator as defined in claim 4, wherein said second permanent magnet reciprocates within the central aperture of said yoke.

* * * * *